US007704466B2

(12) United States Patent
Wu

(10) Patent No.: US 7,704,466 B2
(45) Date of Patent: Apr. 27, 2010

(54) SELF-PROPAGATING COMBUSTION CYCLONE REACTOR

(75) Inventor: Yi-Shuen Wu, Taipei (TW)

(73) Assignee: Sun Materials Technology Co., Ltd., I-Lan Hsien (TW)

( * ) Notice: Subject to any disclaimer, the term of this patent is extended or adjusted under 35 U.S.C. 154(b) by 337 days.

(21) Appl. No.: 11/984,120

(22) Filed: Nov. 14, 2007

(65) Prior Publication Data

US 2009/0123349 A1 May 14, 2009

(51) Int. Cl.
*B01J 8/08* (2006.01)
*B01J 19/00* (2006.01)
*C01B 33/02* (2006.01)

(52) U.S. Cl. ..... 422/232; 422/233; 422/198; 422/199; 422/208; 423/348; 423/350

(58) Field of Classification Search ..... 422/199, 422/198, 208, 232, 233; 423/350, 348
See application file for complete search history.

(56) References Cited

U.S. PATENT DOCUMENTS 2,707,444 A * 5/1955 VanLoon ..... 110/264
3,047,371 A * 7/1962 Krause et al. ..... 422/202
3,541,003 A * 11/1970 Carr et al. ..... 208/230
4,146,359 A * 3/1979 Lumpkin et al. ..... 432/14
4,312,850 A * 1/1982 Dietl et al. ..... 423/350
4,343,772 A * 8/1982 Frosch et al. ..... 422/200
4,668,493 A * 5/1987 Levin ..... 423/349
4,737,348 A * 4/1988 Levin ..... 422/199
4,751,067 A * 6/1988 Levin ..... 423/349
4,753,783 A * 6/1988 Sanjurjo ..... 423/350
4,822,585 A * 4/1989 Dawless ..... 423/348

* cited by examiner

*Primary Examiner*—Walter D Griffin
*Assistant Examiner*—Huy-Tram Nguyen
(74) *Attorney, Agent, or Firm*—Rosenberg, Klein & Lee

(57) ABSTRACT

A self-propagating combustion cyclone reactor includes a reaction chamber delimited by a circumferential wall in which at least one reductant inlet and a plurality of oxidizer inlets are formed in a tangential manner. Reductant and oxidizer are fed, together with inert gas, through the inlets into the chamber in a cyclonic manner to induce self-propagating combustion reaction to generate a product of high purity metal, such as titanium, zirconium, hafnium, or silicon, semiconductor substance. The reactor serves as a continuous reactor for generation of metal or semiconductor substances of high purity.

18 Claims, 3 Drawing Sheets

SELF-PROPAGATING COMBUSTION CYCLONE REACTOR

BACKGROUND OF THE INVENTION

1. Field of the Invention

The present invention relates to a cyclone reactor that employs self-propagating combustion reaction and in particular to reactor inside which self-propagating combustion takes place to continuously generates high purity metals, alloys, or semiconductor.

2. The Related Arts

Metals or semi-conducting substances of extremely high purity are commonly used in modern industrial product. Taking titanium, zirconium and hafnium, or alloys thereof, which are often used in aerospace industry and biomedical industry, as examples, these metals and their alloys feature low density, high specific strength, excellent corrosion resistance, and good biocompatibility. All these factors make them un-replaceable by other substances. However, the physical or chemical properties of these materials, especially those containing inter-metallic compound of titanium and aluminum, are closely related to their purity. Titanium is traditionally generated by Kroll method since 1967 up to now. The manufacturing process has not changed much since the very beginning. Namely, a batch process in which magnesium is employed to reduce titanium tetrachloride for the generation of titanium sponge. The titanium sponge contains a great amount of impurity of magnesium chloride, which must be removed with vacuum distillation or pickling. During this process, impurity or oxides may be contained in the final product of titanium, leading to poor purity thereof. Additional subsequent processes may be needed for further processing in order to obtain titanium metal with low impurity of oxides. This makes high purity titanium very expensive and as a result limits its applications. Thus, development of novel manufacturing process for high purity titanium metal is now one of the challenges to the industry.

Further taking poly-silicon as an example for semi-conducting substances, this substance is commonly used in the modern electronic and photovoltaic industry. It must be of extremely high purity (>6N) in these applications. Known equipments and methods for manufacturing high purity poly-silicon, such as those described in "Handbook of Semiconductor Technology", Noyes Publications, Park Ridge, N.J., USA, pp 2-16, which is the so-called Simens process, and is currently the primary process for manufacturing poly-silicon, begins with employing carbon black in an arc furnace to reduce silica sand to obtain metallurgical grade silicon (MG-Si), which is then put into reaction with hydrogen chloride (HCl) to obtain trichlorosilane ($SiHCl_3$). The impurity contained in the so obtained trichlorosilane is removed by repeated low temperature distillation to obtain purified trichlorosilane. The purified trichlorosilane is heated and reduced in a hydrogen atmosphere vacuum furnace to deposit as high purity poly-silicon. Based on the requirement for purity for different applications, one or more additional processes of directional solidification may be further employed to further enhance the purity. Apparently, Simens process is a time- and energy intensive and thus expensive process for manufacturing high purity poly-silicon for semiconductor or photovoltaic industries. Thus, development of equipments and methods for manufacturing high purity poly-silicon with low costs is now one of the challenges to the industry.

SUMMARY OF THE INVENTION

In view of the above, the present invention is aimed to provide a cyclone reactor that employs self-propagating combustion reaction, in which oxidizer of metal halides and reducing agent of alkali metals and/or alkali-earth metals or other reductants are fed, in gaseous form or liquid form, in a cyclonic manner into the reactor to carry out self-propagating combustion reaction. Thermal energy released by the reaction can be further apply to enhance the reaction and is also applied to heat and maintain products of the reaction in high temperature, whereby the primary product of the reaction can be effectively separated from by-products by means of the cyclonic action to thereby realize continuous and controlled manufacturing of high purity substances.

A first objective of the present invention is to provide a self-propagating combustion cyclone reactor, which uses titanium tetrachloride as oxidizer and metallic sodium as reductant to continuously generate titanium metal of high purity and containing minor amount of oxides and to continuously cast titanium ingots during the reaction process.

A second objective of the present invention is to provide a self-propagating combustion cyclone reactor, which uses titanium tetrachloride and aluminum trichloride as oxidizer and metallic sodium as reductant to continuously generate alloy of titanium and aluminum of high purity and containing minor amount of oxides and to continuously cast ingots of titanium and aluminum alloy during the reaction process.

A third objective of the present invention is to provide a self-propagating combustion cyclone reactor, which uses silicon tetrachloride as oxidizer and metallic sodium as reductant to continuously generate poly-silicon of high purity and to continuously cast ingots of poly-silicon during the reaction process.

A fourth objective of the present invention is to provide a self-propagating combustion cyclone reactor, which uses silicon tetrafluoride as oxidizer and metallic sodium as reductant to continuously generate poly-silicon of high purity and to continuously cast ingots of poly-silicon during the reaction process.

A fifth objective of the present invention is to provide a self-propagating combustion cyclone reactor, which uses silicon tetrafluoride as oxidizer and metallic sodium as reductant, and at the same time supplied with sodium fluoride and metallurgical grade poly-silicon, to continuously generate purified metallurgical grade silicon and to continuously cast ingots of poly-silicon with the purified poly-silicon during the purification process.

To realize the objectives, the present invention provides a self-propagating combustion cyclone reactor, comprising a reaction chamber delimited by a circumferential wall in which at least one reductant inlet and a plurality of oxidizer inlets are formed in a tangential manner. Reductant and oxidizer are fed, together with inert gas, through the inlets into the chamber in a cyclonic manner to induce self-propagating combustion reaction to generate a product of high purity metal, such as titanium, zirconium, hafnium, its alloys or silicon or other semiconductor substance. The reactor serves as a continuous reactor for generation of metal or semiconductor substances of high purity.

The effect of the self-propagating combustion cyclone reactor in accordance with the present invention is that a continuous self-propagating cyclonic combustion is carried out inside of reactor with reductant and oxidizer supplied thereto so as to enhance the purity of the reaction product without the need of repeated distillation and refining processes and thus the manufacturing process is simplified, the costs are reduced, and highly purified metals, alloys, and semiconductor materials can be obtained.

Another effect of the self-propagating combustion cyclone reactor in accordance with the present invention is that the self-propagating combustion is a continuous combustion reaction, which allows continuous generation of the reaction product, rather than a bath process, so that the manufacturing efficiency and the product quality of the metals, alloys, and semiconductor materials so manufactured can be enhanced.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
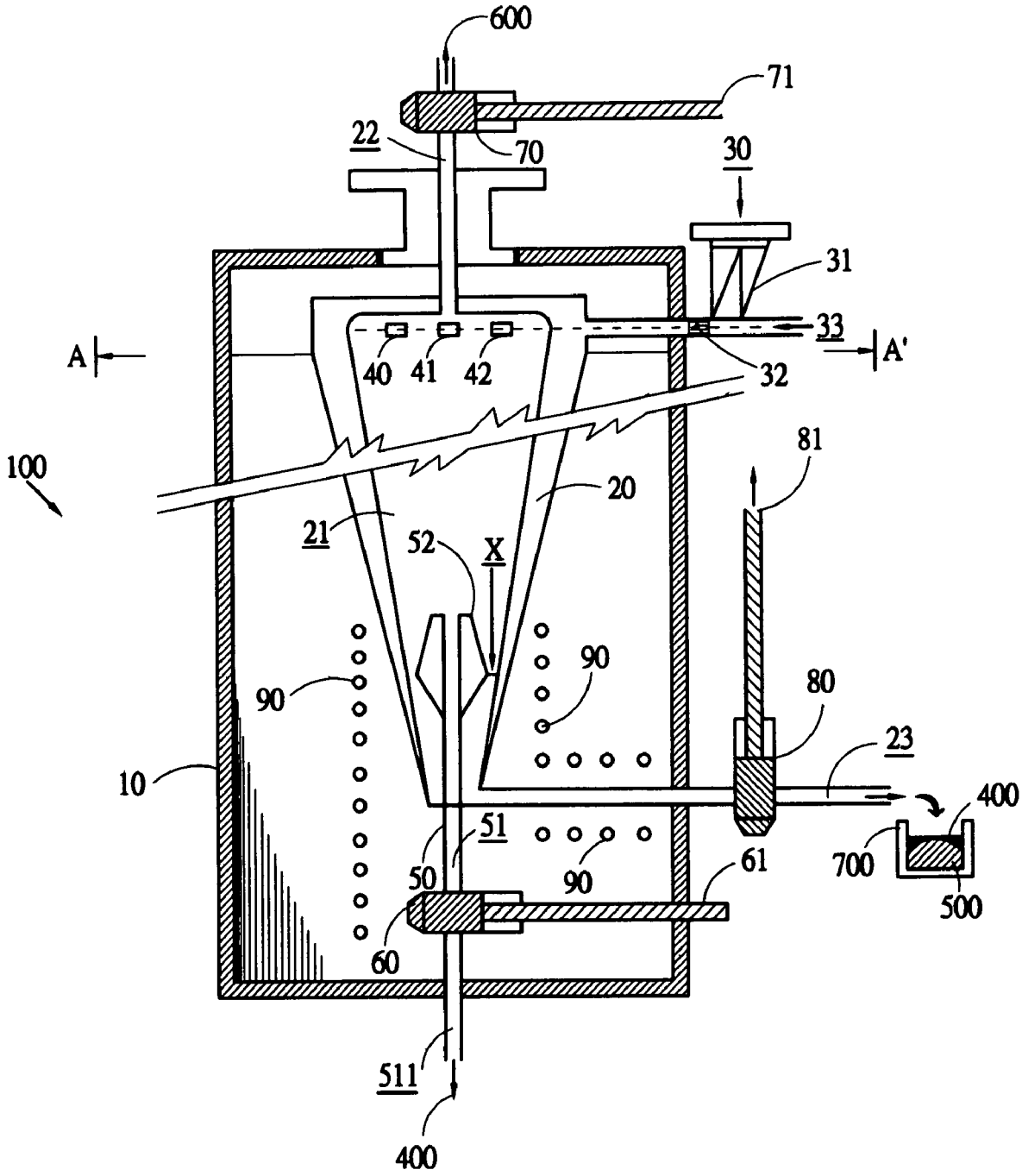
FIG. 1 is a cross-sectional view of a self-propagating combustion cyclone reactor constructed in accordance with the present invention.

With reference to the drawings and in particular to FIG. 1, a self-propagating combustion cycle reactor constructed in accordance with the present invention, generally designated with reference numeral 100, is shown. The reactor comprises an enclosure 10, a reactor lining 20, at least one reductant inlet port 30, a plurality of oxidizer inlets 40, 41, 42, 43, 44, and 45, a by-product drive rod 50, a first control valve 60, a second control valve 70, a third control valve 80, and a plurality of secondary heaters 90. The enclosure 10 is made of thermal insulation material. The reactor lining 20 is arranged inside the enclosure 10 and enclosed by the enclosure 10. The reactor lining 20 is made of isostatic high-density graphite. The reactor lining 20 can be of any desired shape and an inverted cone is taken as an example in the embodiment illustrated. As shown, the inverted conic lining 20 has an upper end having a large diameter and an opposite lower end having a small diameter. The inverted conic lining 20 forms a hollow chamber 21 that communicates a gas outlet 22 and a product outlet 23 formed on the upper and lower ends of the lining 20. The gas outlet 22 extends outside the enclosure 10. The product outlet 23 also extends outside the enclosure 10.

Figure 2:
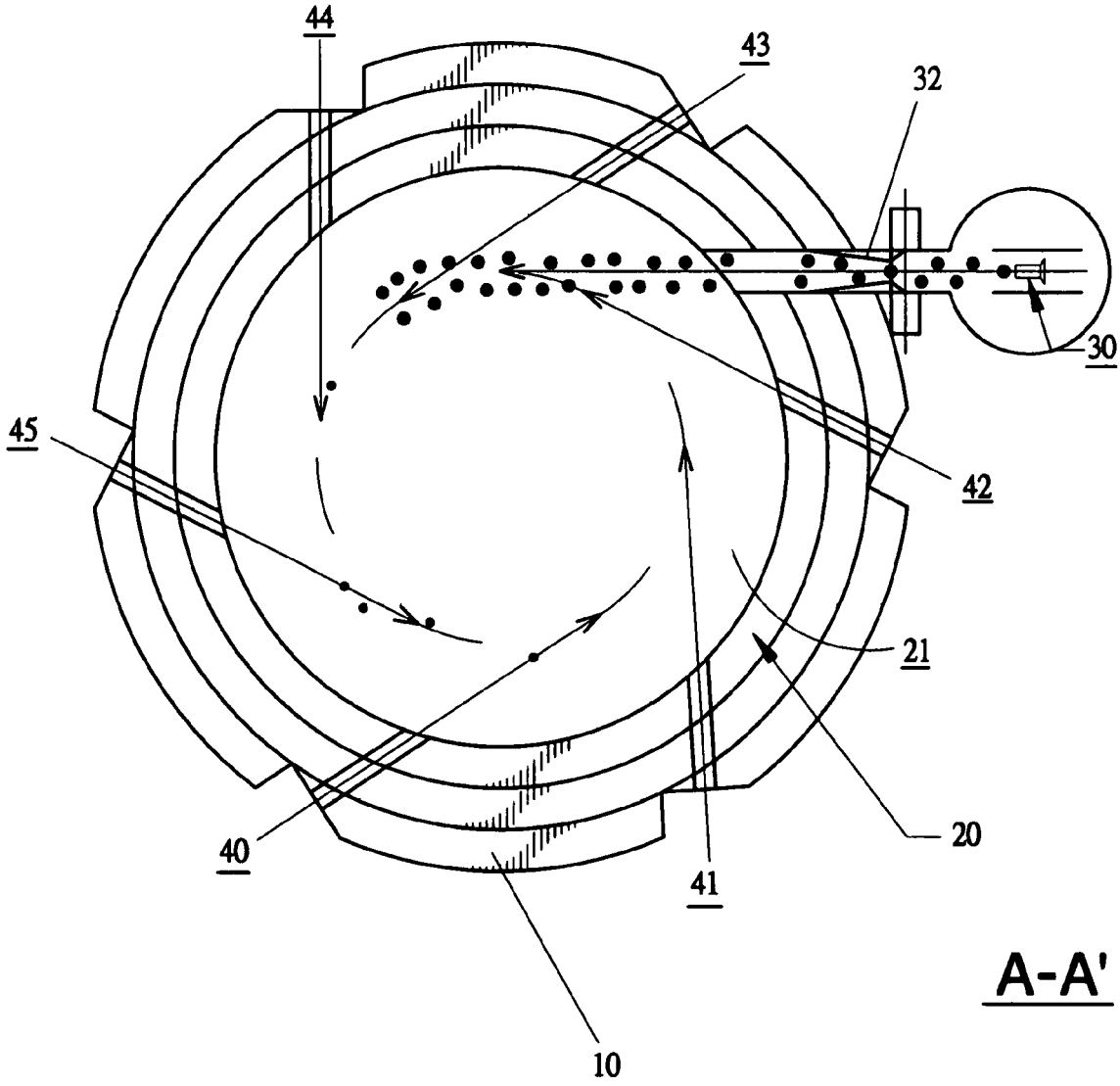
FIG. 2 is a cross-sectional view taken along line A-A' of FIG. 1, illustrating spatial relationship among a reaction chamber of the reactor, a reductant inlet, and a plurality of oxidizer inlets.

Also referring to FIG. 2, the reductant inlet 30 is formed at a point on a circumferential wall of the lining 20 in a tangential manner. The reductant inlet 30 communicates an upper portion of the chamber 21. A heater 31, a nozzle 32, and a gas pressurizing opening 33 are arranged below the reductant inlet 30. The reductant inlet 30 serves to receive a reaction reductant 200, which comprises substances that provide reduction function in a chemical reaction, especially elements of Group 1A, 2A of periodic table, and alloys thereof, or zinc and aluminum that have high chemical activity. The reductant can be in the form of powders that are molten by being heated by the heater 30 to form melt that is then injected into the hollow chamber 21 of the lining 20 by means of the nozzle 32. The heater 31 serves to heat the reductant 200 in case when the reductant 200 is solid in room temperature so as to convert the reductant 200 into a liquid form before the reductant 200 is supplied to the nozzle 32, or alternatively and additionally, the heater 31 serves to maintain the liquid form of the reductant 200. The nozzle 32 can be made of any suitable material that is compatible to the reductant and in the embodiment illustrated, a material that features corrosion resistance and impurity control is used, for example nickel based alloys, such as Inconel 600.

To facilitate the reductant 200 to flow into the lining 20, pressurized inert gas, such as helium or argon, is supplied through the gas pressurizing opening 33. In case the reductant 200 is in the form of powders, the nozzle 32 can make use of the pressure of the inert gas supplied through the gas-pressurizing opening 33 to control the injection speed of the powder reductant 200. In case the reductant 200 is in liquid form, the liquid reductant 200 can directly pressurized in the nozzle 32, or the pressurized gas is used to pressurize the liquid reductant to form mist sprayed into the chamber 20.

The oxidizer inlets 40-45 are arranged at points along the circumferential wall of the reactor lining 20 in tangential manner. The oxidizer inlets 40-45 are in communication with the upper portion of the hollow chamber 21 of the lining 20. The oxidizer inlets 40-45 each serve to receive reaction oxidizers 300, which provide oxidization function for chemical reaction, especially metal halides, such as titanium tetrachloride ($TiCl_4$) and Aluminum trichloride ($AlCl_3$), and silicon halides, such as silicon tetrachloride ($SiCl_4$) and tetrafluoride ($SiF_4$). The oxidizer inlets 40-45 can be of any desired types, such as Venturi tubes, for pressurizing the oxidizer 300 supplied thereto.

The drive rod 50 extends through the lower end of the lining 20 into the hollow chamber 21 of the lining 20. The drive rod 50 is driven by for example a motor, a pneumatic cylinder or a hydraulic cylinder to selectively move upward and/or downward inside the hollow chamber 21 of the lining 20. The drive rod 50 is a hollow member and defines therethrough a channel 51 co-extensive therewith. An inner end of the drive rod 50, which is located inside the hollow chamber 21, is provided with a conic regulation member 52. The upward/downward movement of the drive rod 50 with respect to the lining 20 displaces the regulation member 52 with respect to the lower end opening of the lining 20 thereby regulating the size of the gap between the regulation member 52 and inside surface of the lining 20. An outer end of the drive rod 50 forms a by-product outlet 511 communicating the channel 51 for discharging by-product created inside the reactor.

The first control valve 60 is arranged in the middle of the drive rod 50. The first control valve 60 is operated by an operation bar 61 to control opening/closing of the channel 51 of the drive rod 50 so as to selectively open/close the by-product outlet 511. The operation bar 61 is controlled by for example an electrical motor, a pneumatic cylinder or a hydraulic cylinder.

The second control valve 70 is mounted to the gas outlet 22 located on the upper end of the hollow chamber 21 of the lining 20. The second control valve 70 is operated with an operation bar 71 to control opening/closing of the gas outlet 22.

The third control valve 80 is mounted to the product outlet 23 located on the lower end of the hollow chamber 21 of the lining 20. The third control valve 80 is operated with an operation bar 81 to control opening/closing of the product outlet 23.

The secondary heaters 90 are arranged around a circumference of a lower portion of the lining 20 and around the product outlet 23 to provide heating to the lining 20 and the product outlet 23. The secondary heaters 90 can be of any types and electrical heaters are taken as examples for the embodiment illustrated. Other heating arrangements, such as induction heaters or the likes are also applicable within the scope of the present invention.

Figure 3:
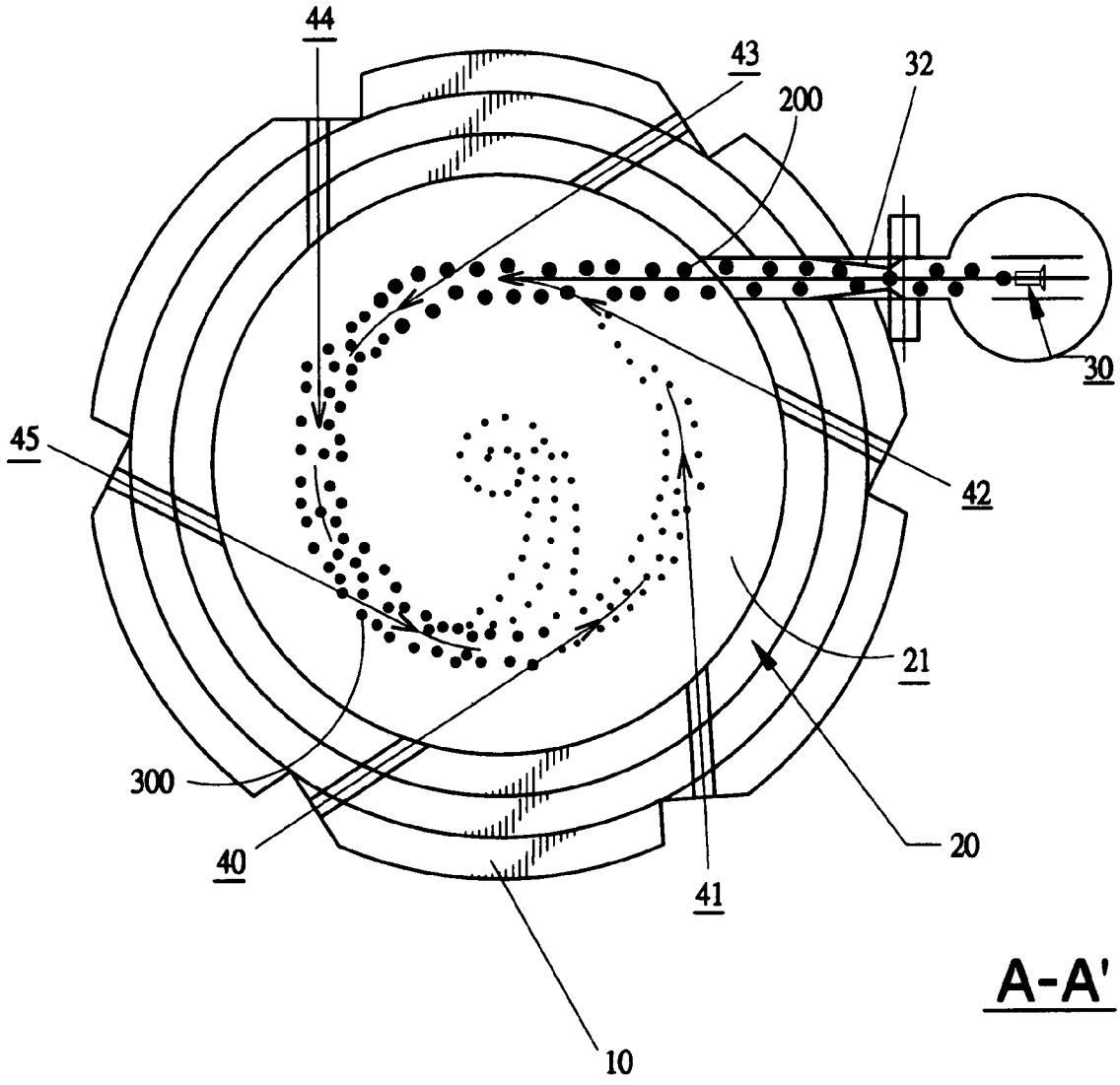
FIG. 3 is a cross-sectional view similar to FIG. 2, demonstrating the cyclonic movement and distribution of the reactants inside the reaction chamber.

Also referring to FIG. 3, an example will be given to explain the operation of the reactor 100 of the present invention. It is, however, understood that the example give below is illustrative, rather than limitative. Equivalents conditions for all the conditions set below, such as feed operation conditions for reductant 200 and/or oxidizer 300, are considered within the scope of the present invention.

In the example, industrial grade sodium is taken as the reductant 200. The reductant 200 is fed through the reductant inlet 30 and is heated by the heater 31 to around 300° C. High purity argon is supplied, at a pressure of 40 PSI, through the gas pressurizing opening 22 to facilitate the reductant 200 of gasified sodium to be sprayed into the lining 20 through the nozzle 32. The reductant 200 is injected into the hollow chamber 21 of the lining 20 in a tangential direction as shown in FIG. 3 and the tangentially supplied reductant 200 impinges on the inside surface of the lining 20 to thereby form a first cyclone.

In the example, the oxidizer 300 is selected to be high purity silicon tetrafluoride, which is fed through all the oxidizer inlets 40-45 at a pressure of 40 PSI. The high purity silicon tetrafluoride can be obtained through the reaction between silicon dioxide ($SiO_2$) and hydrofluoric acid or through thermal pyrolysis of solid $Na_2SiF_6$). The oxidizer 300 that is supplied through the oxidizer inlets 40-45 is fed into the hollow chamber 21 of the lining 20 substantially along tangential lines of the lining 20, as shown in FIG. 3. The oxidizer 300 supplied into the hollow chamber 21 impinges on the inside surface of the lining 20 to thereby form the second, third, fourth, fifth, sixth, and seventh cyclones.

The reductant 200 and the oxidizer 300 are supplied into the chamber 21 along tangential lines of the lining 20 and once entering the chamber 21, the reductant 200 and the oxidizer 300 collide, abrade, and shear each other, thereby inducing chemical reaction, which reduces the oxidizer 300. In case the reductant 200 enters the hollow chamber 21 in a powder form, the powder will be impacted and thus pulverized by the gaseous oxidizer 300. In case the reductant 200 enters the chamber 21 in a liquid form, the liquid will be impacted and atomized by the gaseous oxidizer 300. In the reaction occurring inside the chamber 21, the halide-based oxidizer 300 will be reduced to metal through the exothermic reaction. The heat of the reaction released increases the particle moving speed of the reactants to thereby form enhanced cyclones. Further, the pressurization caused by the Venturi tubes of the oxidizer inlets 40-45 ensured complete reaction between the oxidizer 300 and the reductant 200. The reductant 200 and the oxidizer 300 not only participate the reaction, but also cause high speed rotation inside the chamber 21, which induces centrifugal forces acting on solid particles or liquid droplets of the reductant 200 and oxidizer 300 whereby the particles or droplets are forced to move close to the inside surface of the lining 20 where the particles and the droplets are subject to impact by the gas flow of the gaseous oxidizer 300 that is just forced into the chamber 21 by the Venturi tubes of the oxidizer inlets 40-45. The new impact on the particles and/or droplets by the gas flow of the gaseous oxidizer 300 that just enters the chamber 21 further pulverizes the particles and droplets. This process is repeated a number of times until the particles or droplets become tiny enough to eliminate the effect of centrifugal force. Being such a tiny size, the reactants flow the cyclone to move toward the lower end opening of the chamber 21.

When the reductant 200 and the oxidizer 300 enter the chamber 21 of the lining 20, the silicon tetrafluoride (or metal halide) of the oxidizer 300 and sodium of the reductant 200 collide each other and undergo chemical reaction, in which the heat of the reaction released for each mole of silicon tetrafluoride is 164 Kcal. Thus, the inside temperature of the chamber 21 raised by the reaction may reach as high as 1000-1200° C., which is sufficient to melt the byproduct 400 (sodium fluoride, NaF) of the reaction into a liquid. The primary product 500 of the reaction, which is silicon that is reduced by sodium, still maintains a powder form at a high temperature of 1412° C. When primary product 500 and the by-product 400 of the reaction are carried by the cyclones to move circularly inside the chamber 21, due to the difference in density, they are subject to different centrifugal forces and are thus separated in a downward direction along the conic configuration of the chamber 21. The melt by-product 400 of sodium fluoride is of high reactivity with respect to compound of transition metals and thus in practice can be used to extract the impurity and purity the product. The by-product 400 of sodium fluoride together with the secondary heaters 90 to increase inside temperature of the chamber 21 for melting the primary product 500 (namely silicon). In other words, the high reactivity of the by-product 400 of sodium fluoride is used to enhance purity of the primary product 500 of silicon.

Besides a minor amount of non-reacted silicon tetrafluoride, the exhaust gas 600 generated in the chamber 21 comprises primarily argon. The exhaust gas 600 is discharged through the gas outlet 22 above the chamber 21 and the second control valve 70 controls the discharge operation and timing of discharge. Argon contained in the exhaust gas can be purified and recycled for reuse.

The drive rod 50 is moved into the chamber 21 and set at a predetermined location, whereby the regulation member 52 on the top end of the drive rod 50 is spaced from the inside surface of the chamber 21 by a predetermined and controlled gap X. The gap X is regulated by moving the drive rod 50 with respect to the conic inside surface of the chamber 21 and the regulation of the gap X can be done in accordance with separation ratio and separation speed between the by-product 400 and the primary product 500. In an embodiment of the present invention, the gap X is set to 4 mm. The liquid melt of the by-product 400 of sodium fluoride, which has a low density, is separated and flows through the channel 51 of the drive rod 50 to the by-product outlet 511. The first control valve 60 controls the discharge of the by-product 400 through the channel 51.

Due to the circular movement of the cyclones inside the chamber 21, the primary product 500, namely silicon in the embodiment illustrated, as well as a minor amount of the by-product 400 (sodium fluoride), is forced by the centrifugal force toward the inside surface of the chamber 21, guided by the inside surface through the gap X to reach the lower end opening of the chamber 21. Meanwhile, the secondary heaters 90 supply thermal energy to raise the temperature of the lower portion of the lining 20 and the product outlet 23 to approximately 1500° C. to allow the silicon melt of the primary product 500 and the minor amount of sodium fluoride of the by-product 400 to flow through the product outlet 23 to a graphite container 700. The third control valve 80 controls the flow of the melt of the primary product 500 through the product outlet 23. Due to the fact that the silicon melt of the primary product 500 ad the sodium fluoride of the by-product 400 do not react each other and also due to the fact that they have different densities, the silicon melt of the primary product 500, which has a high density, will settle on the bottom of the graphite container 700 and will then get cooled and form an ingot of poly-silicon. The minor amount of liquid sodium fluoride of the by-product 400, which has a low density, will float above the primary product 500. Thus, after subjecting to directional solidification and surface cleaning, the primary product 500 provides poly-silicon of high purity.

The primary product 500 is discharged through the product outlet 23, but can be cooled in any suitable manner, not just by means of a graphite container. This is basically determined in accordance with the subsequent process and it is apparent that all these variations are considered within the scope of the present invention.

The follow table, Table 1, shows a constituent list of the impurities contained in the poly-silicon obtained from the primary product 500 in accordance with the present invention. The table is obtained using plasma emission spectroscopy analysis on the primary product 500.

TABLE 1

| | element | | | | | | | | |
|---|---|---|---|---|---|---|---|---|---|
| | Mo | Pb | Zn | Cu | Cr | Mn | Fe | Co | Ni |
| ppm (wt) | <0.01 | 0.04 | <0.01 | <0.01 | <0.01 | <0.01 | 0.06 | 0.016 | 0.02 |

Based on the list of the impurities, it is obvious that the poly-silicon of the primary product obtained through the reactor 100 of the present invention is of very high purity, and contains only a very minor amount of impurity. Thus, the reactor of the present invention is applicable in self-propagating combustion to obtain poly-silicon of high purity, as well as other metals, such as titanium, zirconium, and hafnium, and is also applicable to purification of low purity or impurity-contained poly-silicon, titanium, zirconium, and hafnium, or alloys thereof, and can also serve as a purity enhancing reactor 100. For example, the low purity or impurity-contained poly-silicon, titanium, zirconium, and hafnium, or alloys thereof can be fed into the chamber 21 of the reactor 100 through any one or more of the oxidizer inlets 40-45, and the reductant 200 and other oxidizer 300 are also fed into the chamber 21 of reactor 100 to induce the self-propagating combustion as discussed above for continuous generation of the primary product 500, which in this case, is high purity poly-silicon, titanium, zirconium, and hafnium, or alloys thereof.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A self-propagating combustion cyclone reactor, comprising:

an enclosure;

a lining arranged inside the enclosure and enclosed by the enclosure, the lining forming a hollow chamber and having upper and lower ends forming a gas outlet and a product outlet respectively;

at least one reductant inlet formed in a circumferential wall of the chamber in a tangential manner and communicating an upper portion of the chamber for receiving a reductant and a pressurized gas to supply the reductant into the chamber along a tangential line of the reductant inlet in a pressurized manner to thereby impinge on an inside surface of the circumferential wall of the chamber to induce a first cyclone;

a plurality of oxidizer inlets formed in the circumferential wall of the chamber in a tangential manner and communicating the upper portion of the chamber for respectively receiving oxidizer, the oxidizer being supplied into the chamber along tangential lines of the oxidizer inlets in a pressurized manner to thereby impinge on the inside surface of the circumferential wall of the chamber to induce a plurality of cyclones, whereby, inside the chamber, the oxidizer collides the reductant fed through the reductant inlet to induce self-propagating combustion reaction and thus generating primary product and by-product, the primary product being discharged through the product outlet formed at the lower end of the chamber;

a drive rod extending through the lower end of the lining into the chamber, the drive rod being movable upward/downward with respect to the chamber, the drive rod being a hollow member defining a channel extending therethrough, a conic regulation member being mounted to an inner end of the drive rod that is located inside the chamber that is spaced from the inside surface of the chamber by a gap, the gap being adjustable by the movement of the drive rod with respect to the chamber, the drive rod having an outer end located outside the enclosure and forming a by-product outlet in communication with the channel for discharging the by-product of the reaction between the reductant that is supplied through the reductant inlet and the oxidizer that is supplied through the oxidizer inlets;

a first control valve mounted to the drive rod to control closing/opening of the channel defined in the drive rod;

a second control valve mounted to the gas outlet in the upper end of the chamber to control closing/opening of the gas outlet;

a third control valve mounted to the product outlet in the lower end of the chamber to control closing/opening of the product outlet; and a plurality heaters arranged around a lower portion of the lining and the product outlet to facilitate heating to the lining and the product outlet.

2. The self-propagating combustion cyclone reactor as claimed in claim 1, wherein the enclosure is made of thermal insulation material.

3. The self-propagating combustion cyclone reactor as claimed in claim 1, wherein the lining is made of isostatic high-density graphite.

4. The self-propagating combustion cyclone reactor as claimed in claim 1, wherein the lining is configured as an inverted cone having an upper end of large diameter and a lower end of small diameter.

5. The self-propagating combustion cyclone reactor as claimed in claim 1, wherein the gas outlet of the chamber extends outside the enclosure.

6. The self-propagating combustion cyclone reactor as claimed in claim 1, wherein the product outlet extends outside the enclosure.

7. The self-propagating combustion cyclone reactor as claimed in claim 1 further comprising a heater, a nozzle, and a gas pressurizing opening arrange below the reductant inlet, wherein the heat serves to heat and melt the reductant supplied through the reductant inlet into a liquid form, the nozzle serves to inject the reductant that is supplied in a liquid form or powder form through the reductant inlet into the chamber of the lining, and the gas pressurizing opening serves to supply an inert gas for pressurization.

8. The self-propagating combustion cyclone reactor as claimed in claim 1, wherein the reductant comprises elements of group 1A and/or 2A of periodical table, and/or alloys thereof.

9. The self-propagating combustion cyclone reactor as claimed in claim 1, wherein the reductant comprises high chemical activity substance including zinc and aluminum.

10. The self-propagating combustion cyclone reactor as claimed in claim 1, wherein the oxidizer inlets are configured as Venturi tube.

11. The self-propagating combustion cyclone reactor as claimed in claim 1, wherein the oxidizer comprises gaseous metal halide.

12. The self-propagating combustion cyclone reactor as claimed in claim 11, wherein the gaseous metal halide comprises titanium tetrachloride and/or aluminum trichloride.

13. The self-propagating combustion cyclone reactor as claimed in claim 1, wherein the oxidizer comprises silicon halide.

14. The self-propagating combustion cyclone reactor as claimed in claim 13, wherein silicon halide comprises silicon tetrachloride and/or silicon tetrafluoride.

15. The self-propagating combustion cyclone reactor as claimed in claim 1, wherein an operation bar to control closing/opening of the channel operates the first control valve formed through the drive rod.

16. The self-propagating combustion cyclone reactor as claimed in claim 1, wherein an operation bar to control closing/opening of the gas outlet operates the second control valve.

17. The self-propagating combustion cyclone reactor as claimed in claim 1, wherein an operation bar to control closing/opening of the product outlet operates the third control valve.

18. The self-propagating combustion cyclone reactor as claimed in claim 1, wherein the heaters arranged around the lower portion of the lining and the product outlet comprise electrical heaters.

* * * * *